United States Patent [19]

Wilmotte et al.

[11] 4,305,765

[45] Dec. 15, 1981

[54] COOLING METAL PRODUCTS

[75] Inventors: Stephan H. Wilmotte, Chaudfontaine; Jean A. Nautet, Hony-Esneux; Marios Economopoulos, Liège, all of Belgium

[73] Assignee: Centre de Recherches Metallurgiques-Centrum voor Research in de Metallurgie, Brussels, Belgium

[21] Appl. No.: 148,216

[22] Filed: May 9, 1980

Related U.S. Application Data

[62] Division of Ser. No. 875,981, Feb. 8, 1978, Pat. No. 4,226,108.

[30] Foreign Application Priority Data

| | | | |
|---|---|---|---|
| Feb. 11, 1977 | [BE] | Belgium | 851381 |
| Feb. 11, 1977 | [BE] | Belgium | 851382 |
| Sep. 5, 1977 | [BE] | Belgium | 858416 |

[51] Int. Cl.[3] ..... B21B 45/02; B21B 43/00; C21D 9.46

[52] U.S. Cl. ..... 148/156; 266/113

[58] Field of Search ..... 72/200, 201, 202, 236; 164/89, 444; 266/111, 112, 113; 148/153, 155, 156; 134/15

[56] References Cited

U.S. PATENT DOCUMENTS

| | | | |
|---|---|---|---|
| 1,994,721 | 3/1935 | Lorig et al. | 72/200 |
| 3,687,145 | 8/1972 | Schrader et al. | 266/113 X |
| 3,856,281 | 12/1974 | Bertolotti et al. | 266/113 X |
| 4,076,222 | 2/1978 | Schaming | 266/111 |

FOREIGN PATENT DOCUMENTS

| | | | |
|---|---|---|---|
| 291580 | 6/1928 | United Kingdom | 266/113 |
| 870556 | 6/1961 | United Kingdom | 266/113 |

*Primary Examiner*—Ervin M. Combs
*Attorney, Agent, or Firm*—Holman & Stern

[57] ABSTRACT

A metal product, such as a steel strip or a mill roll, is cooled by spraying a coolant towards a surface of the product travelling along a given path, by means of cooling apparatus comprising two hollow caissons arranged one inside the other and rigidly connected together to constitute a unit. The caissons cool the strip contained within a tunnel. The method is applied to the product surface and extends across the path of the product surface. Each caisson has a plurality of holes in a wall which is to face the product surface, each hole of the outer caisson being paired with a coaxially aligned hole of the inner caisson. A coolant sprayer is fixed in each pair of holes. Preferably, the sprayers are supplied with air from the inner caisson and water from the outer caisson, the water being atomized by the air. The path containing the prouduct is enclosed within a tunnel wherein ends of the tunnel are enclosed by continuous curtains of water which contact the product and effectively seal the ends of the tunnel.

5 Claims, 8 Drawing Figures

24
27
26
23
28
22
17
20
16
19
15
18

17
16
15
20
19
18

COOLING METAL PRODUCTS

This is a divisional of application Ser. No. 875,981 filed Feb. 8, 1978 (now U.S. Pat. No. 4,226,108).

BRIEF AND SUMMARY OF THE INVENTION

This invention relates to methods for cooling a metal product by spraying a coolant towards a surface of the product, travelling along a given path.

The following description is focused on the cooling of metal strip or sheets, but this is only an example of application, since the method can be also applied to metal products of smaller dimensions such as plates, sections, and foil, and even to the rolls of rolling mills. All these rolled products and the mill rolls are indicated simply by the term "product" in this specification.

The problem of cooling rolled products while they are being rolled, or at the outlet of finishing stands, has always been the subject of particular attention because it is the main factor responsible for both the regularity of the structure of the rolled product and its uniform evolution in time.

To this end, one of the methods most used for carrying out this cooling comprises directing onto moving rolled products jets of a suitable fluid, e.g. air, water, steam, either alone or mixture with, or atomized by, one another, the method being carried out by means of sprayers arranged in groups so as to reach in as uniform as possible a manner the cooling zone the rolled product has to cross.

The problem as explained above would seem at first sight to have relatively simple solutions. However, it should be noted that very little space is in general available in the immediate vicinity of a product being rolled, especially in the stands, between the mill rolls, and at the outlet of the stands between the rolls supporting the rolled product.

To reduce this drawback, apparatuses have already been suggested and produced which form a jet of a cooling agent reaching a rolled product located at great distance, for example 50 cm to 1 m. In this way, it is possible to cool a rolled product by directing at it a jet of this kind, which can easily pass between two successive rolls, even if they are arranged close to each other.

It will, however be understood that, and this is a great disadvantage, such a jet is far from having uniform density when it reaches a rolled product, it is not effectively adjustable, the distance being the same, and finally a group of jets arranged accurately parallel to one another can be obtained only with difficulty. Furthermore, it is impossible at these distances to give the cooling fluid a possibly variable optimum structure which would permit the rolled product in question to be uniformly and effectively cooled.

What is desired is apparatus for cooling metal products, by means of which it is possible to adjustably and uniformly cool metal products even while the metal products are passing between successive rolls supporting them.

The present invention provides a cooling apparatus substantially characterized in that it comprises two hollow caissons or manifolds arranged one inside the other and having lengths which suit the width of the product to be cooled, the transverse overall dimensions of the outer caisson allowing the caisson to be located in a desired position (e.g. between two successive rolls carrying the product) at a short distance from the product, preferably smaller than 10 cm, that the two caissons are each provided on their front face, i.e. the face out of which the cooling fluid is ejected, with a number of holes, each hole of the outer caisson being arranged aligned and coaxial with a hole of the inner caisson, a suitable sprayer being fixed in each pair of holes, and that the two caissons are rigidly fixed to each other, preferably by means of hollow sections (e.g. tubes) which also serve as supply ducts for supplying the caissons with cooling fluids.

The two caissons can, for example, be fixed together either at their rear faces or at their sides. However, the caissons are preferably fixed together by means of inner cross-pieces which have the advantage of directing cooling water to the sprayers through a very short path having approximately the same length for all the sprayers, which further enhances the homogeneous character of the cooling fluid.

The above described assembly of two caissons provided with their sprayers can be easily arranged in the desired position, for example between two successive rolls carrying the product at the outlet of a rolling mill, so that the front face of the apparatus is arranged spaced from the said product a distance which is usually smaller than 10 cm. It is thus possible to obtain at a short distance from the product to be cooled a jet of cooling fluid by means of sprayers which emit a fluid whose density can be kept uniform through such a small distance until the fluid reaches the part of the product within the range of each sprayer. By arranging these sprayers staggered in the caissons, it is possible to easily cover in an almost uniform manner, along a predetermined length, substantially the entire width of the product in question.

The apparatus permits adjustment of the cooling intensity either by changing the sprayers or by altering the pressure or pressures of the fluids supplied to the sprayers.

In particular, in the case in which one is dealing with the rolls of a rolling mill, uniform cooling of these rolls is a matter of particular importance.

It is well known that cold or hot rolling of metal products causes the temperature of the rolls of the rolling mill to increase. This temperature increase is not uniform in the cross-section of, and along, the rolls but is greater in the middle of the rolls than at their ends, at the surface of the rolls in contact with the rolls in contact with the rolled product. This temperature increase, in turn, results in a corresponding expansion of the rolls, and thus the products to be rolled have not the same thickness everywhere but tend to form to a certain extent a concavity at their central part. Such a concavity may increase until longitudinal rupture of the rolled product occurs. This defect occurs in addition to a corresponding lack of planeity. These two drawbacks present themselves simultaneously and interact with each other.

Thus, it will be readily understood that there is great interest in obtaining as homogeneous as possible a temperature increase in the rolls of a rolling mill to avoid the above described drawbacks. Accordingly, one of the methods adopted hitherto comprises increasing as far as possible the cooling of the rolls, and this can be done in particular by means of the apparatus in accordance with the present invention.

The apparatus, when adapted to cool a roll in a rolling mill, preferably comprises two, and preferably three, units, each unit comprising two hollow caissons arranged one inside the other, the length of the caissons being adapted to the length of the roll to be cooled, whereas the transverse overall dimensions of each outer caisson is such as to permit its location in a desired position, that the two caissons are each provided on their front face, i.e. the face arranged in front of the roll to be cooled, with a number of holes, each hole of the outer caisson being arranged in alignment and coaxial with a hole of the inner caisson, a suitable sprayer being fixed in each pair of holes, means for supplying each unit with a predetermined cooling fluid, means for altering the supply pressure of the fluid in one or several units, means for switching on or off one or more of the said units.

This apparatus has the advantage of permitting effective adjustment of the cooling by modifying the supply pressure and the number of units switched on.

According to an advantageous embodiment of this apparatus, each unit is straight and the sprayers on each unit are distributed in a non-uniform manner; preferably the distance between two adjacent sprayers is gradually smaller in proportion as one moves towards the centre of the unit (i.e. when moving along its length), the distribution thus obtained making it possible to increase cooling in the middle of the cylinder.

According to a further advantageous variant, the sprayers are longitudinally distributed in the form of a bell on each unit, but follow different curves, which makes it possible, by modifying either the number of the units in operation, or the supply pressure of one or several units, to obtain a large number of different possibilities of cooling the roll, thereby making the arrangement particularly suitable for adapting instantaneously and in an actually suitable manner the cooling characteristics to the indications obtained by a mathematical model.

In the above described apparatus, a large number of types of sprayer and cooling fluid can be used, but preferably use is made of sprayers axially supplied with air by way of the internal caisson and laterally supplied with water which is designed to be atomized by the air, the water supply taking place by way of the outer caisson.

Within the application of the apparatus to the cooling of rolls of rolling mills, a particularly advantageous method makes it possible to considerably reduce the camber (i.e. the convexity or bulging) of the rolls which is due to temperature increase, and thus permits elimination of the various drawbacks caused by the temperature increase.

In the method carried out during a rolling operation of metal products, the camber of at least one of the rolls is determined, the camber thus determined is compared with a value which is taken as an ideal value for the camber, the operating characteristics of a cooling apparatus for the roll are suitably altered so as to reduce or annul any discrepancy between the determined convexity and the ideal convexity, the cooling apparatus comprising means for effecting at a short distance, preferably not greater than 10 cm, longitudinal differential cooling of the cylinder.

This method (which proved to be insufficient with the known cooling apparatuses for rolled products) has become sufficiently rapid to be considered as advantageous, owing to the greatly increased effectiveness of the cooling apparatus.

According to a first example, the camber is determined by measuring the cross-section of the rolled products.

According to a second example, use is made of a mathematical model which makes it possible to know in any given time the actual camber of the roll in question, and the cooling conditions are modified as soon as the difference between the calculated camber and the ideal camber existing in one or several points of its profile reaches a predetermined value. This example allows one to foresee, within certain limits, the future probable state of the camber and to take measures in advance for correcting it.

According to an advantageous variant of this method, longitudinal differential cooling of the roll is simultaneously effected in several zones, which enhance the cooling effect due to the method.

According to another advantageous variant of the method, the number of zones where jets of cooling fluid are directed at the cylinder is altered according to requirements and/or the pressure of the jets or their distribution is modified.

DESCRIPTION OF THE DRAWINGS

The invention will be described further, by way of example only, with reference to the accompanying drawings, in which.

DESCRIPTION OF A PREFERRED EMBODIMENT

Figure 1:
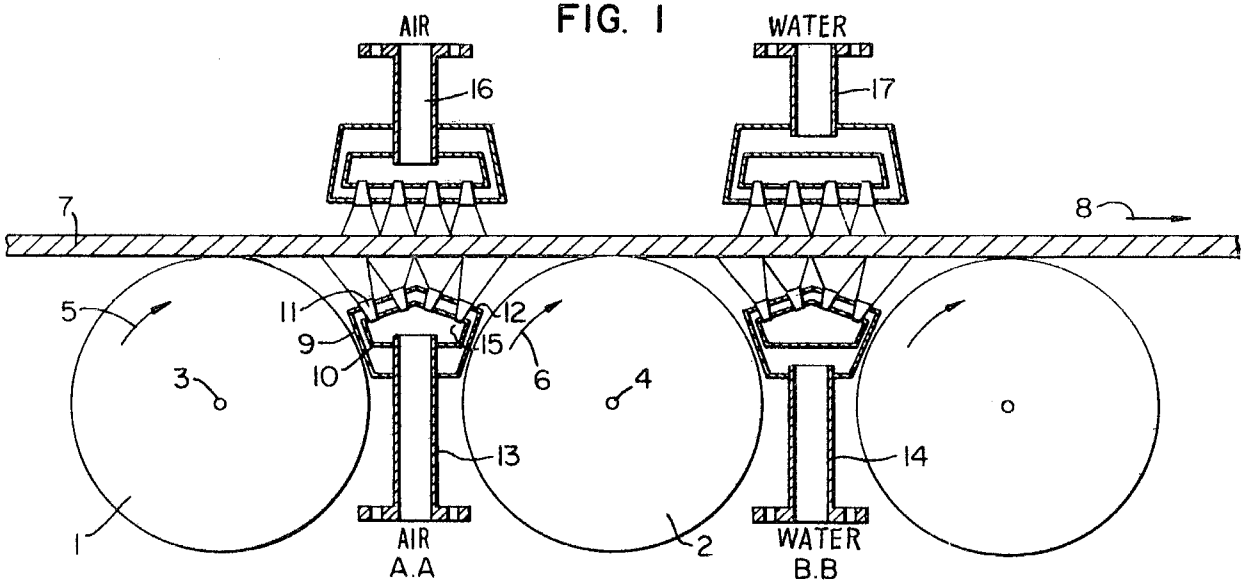
FIG. 1 shows a vertical section through an installation for cooling metal strip.
Figure 2:
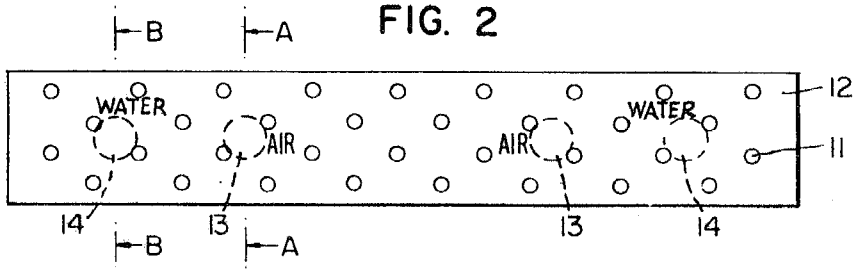
FIG. 2 is a plan view of part of the installation.

FIG. 1 shows a vertical cross-section, taken in the rolling direction, of an installation for cooling steel strip 7. In FIG. 1 two successive carrying rolls 1 and 2 are mounted for rotation about their axes 3 and 4, respectively, in the direction indicated by arrows 5 and 6. These two rolls displace the strip 7 in the direction indicated by an arrow 8. A cooling apparatus acting on the lower surface of the strip 7 is located between the two rolls 1, 2. This apparatus comprises two caissons or manifolds 9 and 10 arranged one inside the other and connected to each other at their upper sides by means of sprayers 11 distributed in four staggered series. FIG. 2 diagrammatically illustrates how the sprayers are arranged on the upper side 12 of the outer caisson 9. The sprayers are supplied with air by way of ducts 13 (section A—A) and with water by way of ducts 14 (section B—B), the air reaching the sprayers through the inner caisson along their axes 15, whereas water laterally reaches the sprayers between the two caissons 9 and 10.

Similar apparatuses (16, 17) are directed at the upper surface face of the strip 7 in a position opposite to that of the apparatuses directed at the lower surface, which makes it possible to obtain practically identical cooling of the two surfaces of the strip even between the carrying rolls. However, cooling from below is sufficient in most cases.

The front and rear faces of the internal caisson may advantageously be interconnected by means of hollow sections which permit direct passage of cooling water to an area close to the sprayers. According to this variant, the cooling water no longer has to follow the outer periphery of the internal caisson to reach the sprayers.

Figure 3:
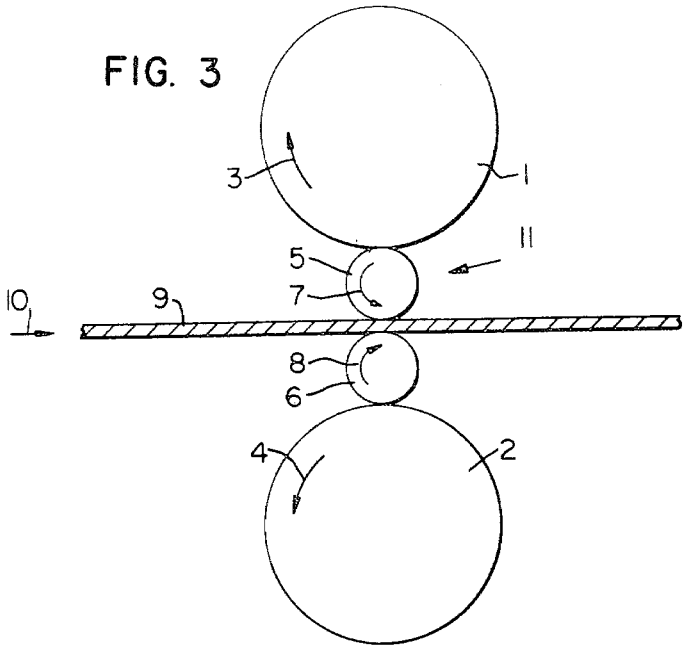
FIG. 3 shows a vertical section through a strip rolling mill stand.
Figure 4:
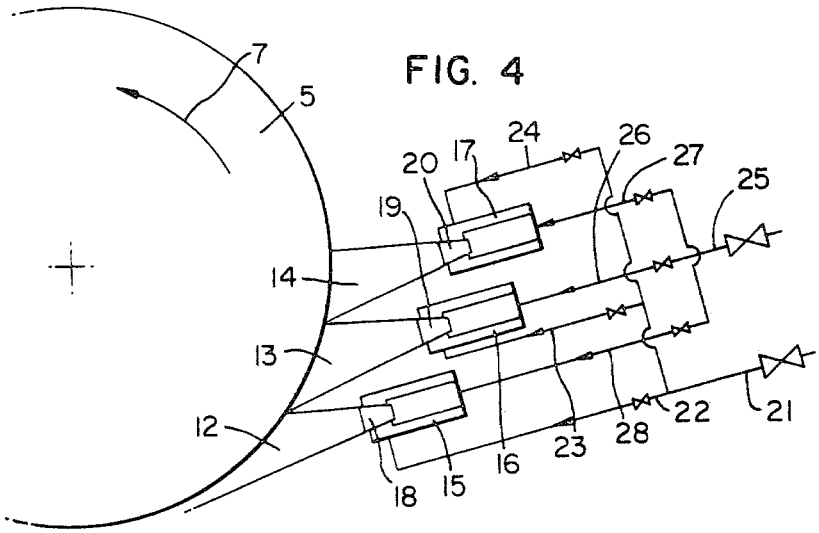
FIG. 4 diagrammatically illustrates the cooling of a mill roll.
Figures 5A, 5B:
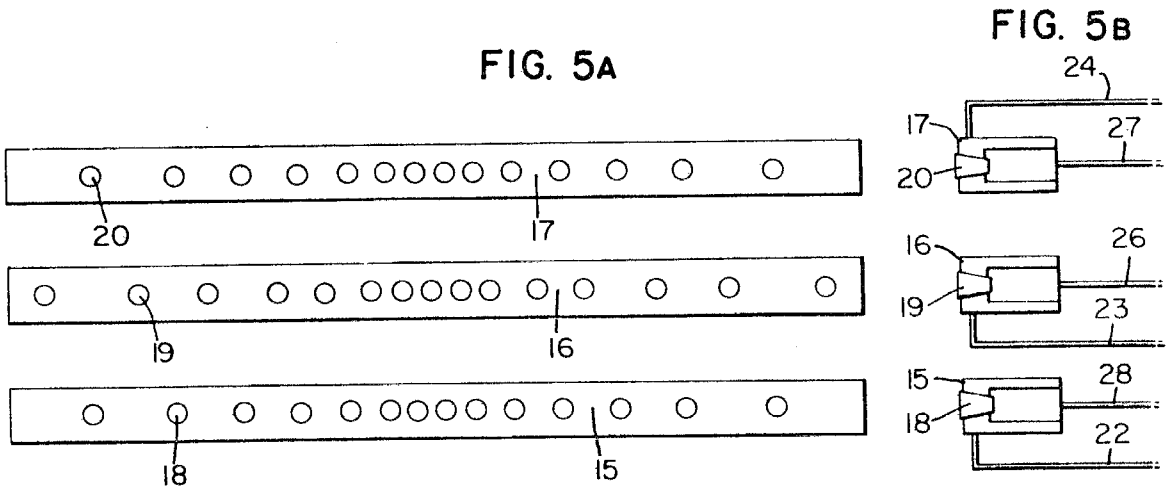
FIG. 5*a* is a front elevation of an installation for cooling a mill roll.
FIG. 5*b* is a diagrammatic side view of the installation of FIG. 5*a;*

FIG. 3 diagrammatically illustrates a longitudinal (with respect to the rolling mill) vertical cross-section of the rolls in a stand of a strip rolling mill provided with cooling apparatus according to the invention. FIG. 4 diagrammatically illustrates a vertical cross-section (transversely to the roll) of the apparatus associated with one of the mill rolls. FIG. 5 shows a front view of a possible distribution of sprayers on the three units of the apparatus.

In FIG. 3, the two back-up rolls 1 and 2 in the stand in question are driven in the directions indicated by arrows 3 and 4, respectively, by the motor of the stand (not shown). These two rolls drive the working rolls 5 and 6 in the direction shown by arrows 7 and 8 respectively. The strip 9 is displaced between the two rolls 5 and 6 in the direction indicated by an arrow 10.

The cooling apparatus according to the present invention is diagrammatically indicated by arrow 11; its cooling action being directed downwards towards the downstream part of the roll 5.

FIG. 4 shows the roll 5 rotating in the direction of the arrow 7. Three units, having groups of sprayers 18, 19, 20 supplied with water at 21, 22, 23, 24 and with air at 25, 26, 27, 28, direct a coolant at the roll 5 along jets 12, 13, 14. The supply circuits comprise air and water control valves. It will be clearly understood that by means of the above-mentioned system of valves it is possible to set in operation one or two or three of the illustrated units or assemblies and to separately modify the pressure at which they are supplied. If necessary, use can be made of a fourth unit.

FIG. 5 diagrammatically illustrates a front view of a group of three units 15, 16, 17 of caissons and sprayers and a side view of the same group. Sprayers 18, 19, 20 are distributed on the front faces of three groups, the space between successive sprayers being smaller at the centre of the units than at the their ends. However, the absolute value of these distances differs from one unit to the other. It should be noted that for the units 16 and 17, the sprayers are arranged staggered so as to obtain a predetermined uniform cooling throughout a larger width of a roll.

As mentioned above, alterations made in the cooling characteristics of the roll may depend upon a mathematical model making it possible to predetermine in any instant the thermal camber of a predetermined roll in given operating conditions. This operation aims at adjusting the cooling action, i.e. both its distribution and intensity over the stands, so as to obtain a thermal camber such that:

profile dispersion of strip at the outlet of the rolling mill is smaller than a given value.

planeity of the strip is good (in accordance with a given standard), stability of the strip is satisfactory during the rolling operation.

The apparatus can be used, as already mentioned above, in many applications while keeping all its specific advantages, i.e.

high specific cooling capacity (up to 5 $MW/m^2$), extended adjusting range: for a given sprayer the maximum to minimum specific cooling capacity ratio is higher than 30, uniformity of cooling.

Normal operating conditions of these sprayers are: water pressure $(P_w)=3.5$ $kg/cm^2$ (range: 0 to 4.5 $kg/cm^2$) air pressure $(P_a)=4$ $kg/cm^2$ ($p_a=p_w+0.5$ $kg/cm^2$, with a minimum of 2 $kg/cm^2$), The flow rate per sprayer at the above pressures being:

water flow rate $(d_w)=7$ l/min air flow rate $(d_a)=3$ $Nm^3/h$.

Various applications of this apparatus are described below.

1. Cooling of Flat Products Being Displaced in a Horizontal Plane (Sheets or Strip)

Example

Groups of sprayers used for cooling from below upwards in a hot rolling mill for wide strip.

Measured specific cooling capacity: 1.6 MW per square meter of total surface. Specific flow rate: 14 $l/m^2.s$ (against 0.44 $MW/m^2$ as a maximum for conventional apparatus having the same specific flow rate). Use of six groups (arranged between 7 successive carrying rolls) spraying a mist made it possible to cause the winding temperature of a strip 2 mm thick and moving at a speed of 9.5 m/s to fall 40° C.

2. Cooling of Flat Products Being Displaced in a Vertical Plane (Strip)

Example

Groups of sprayers arranged on either side of the channel or trough provided at the outlet of a strip rolling mill through which the product is displaced in a vertical plane.

Total length of the channel: 7 m.

Actual length of the cooling apparatus: 4.5 m.

Specific cooling capacity (average value over the entire surface): 1.85 $MW/m^2$.

For a product 6 mm thick being displaced at a speed of 5.5 m/s, the temperature fall is 150° C.

3. Cooling of Sections

Example

Use of groups ejecting a mist for cooling inner and outer faces of flanges.

Total length of the installation: 7.5 m.

Actual length of the cooling apparatus: 6 m (4 sections each 1.5 m long).

Specific cooling capacity (average value over the entire surface): 1.80 $MW/m^2$.

For a beam of type 100 M (flange 22 mm thick) passing through the cooling zone at a speed of 2.8 m/s, the decrease in the average value of the temperature in the thickness of the flange is 110° C.

4. Cooling of Rolls

Cooling tests on the rolls of a strip rolling mill (installation of cooling zones using a mist for spraying the upper rolls of the two last stands at the outlet end of the rolling mill).

Results obtained:

With respect to a conventional cooling installation, the following results were found:

reduction of more than half in the water flow rate,
improvement of the profile of the strip (reduction in the amplitude of grooves during rolling at high speed of strip for making tubes),
30% increase in the rate during rolling of thin and hard strip,
slight decrease in roll wear.

The present invention also relates to a method which, when applied to an apparatus of the above described type when applied to rolled products, makes it possible to considerably lower its sound level. Moreover, such a method makes it possible to eliminate steam and mist leakages into the rooms.

A number of devices for reducing the sound level in cooling installations of the above-mentioned type have already been suggested and include in particular arranging the said installation in a longitudinal tunnel covering the cooling zone or zones. Such installations permit the sound level emitted transversely to the cooling zone to be substantially reduced, but as a counterpart they increased the sound level longitudinally generated at the inlet and the outlet of the tunnel.

Furthermore, mist and vapors ejected during cooling easily and extensively scattered in the rooms where cooling was carried out, which was often a detrimental factor from the health point of view.

The method according to the present invention, in which use is made of a cooling installation for metal rolled products, the installation being arranged in a longitudinal tunnel, is substantially characterized in that the end openings of the said tunnel are closed by means of an uninterrupted water curtain, layer or sheet having a suitable thickness and whose descending trajectory is such that the inner side wall of the said water layer is in contact with the edge of the said opening along its entire periphery, the said edge permanently contacting the said layer or sheet without crossing it or departing from it in any point.

The most advantageous position of this water layer extending in a vertical plane, is usually that perpendicular to the longitudinal axis of the installation, since in that way the device for carrying out the above described process is particularly simple.

In practice, the two ends of the tunnel including the cooling installation are shaped in such a way that they are accurately planar (with no projections), vertical and with no interruption along them, and the continuous water sheet in question extending in a vertical plane is arranged in such a way that its face facing the installation comes and remains accurately in contact throughout the entire extension and the periphery of the said ends, which makes it possible to obtain perfect closing of these ends except however the zone of the said sheet which is affected by rolled product passing through the cooling installation.

It was found that such a closing permitted not only the sound level from the cooling installation, more specifically from the mist sprayers, to be considerably reduced, but dispersion of mist and vapors in the installation environment was almost completely eliminated, which is a supplementary advantage particularly desirable from the point of view of safety and health in the working conditions.

Various methods can be envisaged to produce such a water sheet and for directing it in a rigorously accurate manner. However, it has been found to be particularly advantageous to direct this water sheet in an elongate channel having an outlet orifice on its lower part in the form of a thin slit (for example 2 mm wide), at least the two long sides of the slit being prolonged in the direction of the displacement of the water by a guide plane in the form of a thin sheet which controls the trajectory of the water sheet from the slit.

According to a particularly advantageous embodiment of the above described device, one of the two guide sheets has, in the direction of displacement of the water, one dimension slightly greater than the other and is arranged on the side of the installation so that while extending above the tunnel, the plane containing its inner face coincides with that of the adjacent end of the tunnel, the said slit being also positioned so that the water sheet from it completely covers the outlet opening of the tunnel starting from its upper part.

The channel may be supplied in various ways, but it has been found to be particularly advantageous to supply it by means of an elongated header arranged above the channel, the outlet of the header comprising, in the longitudinal direction of the groove, two convergent side walls, which are preferably plane, and lead to the channel, whose inlet also has a convergent part preferably extending to the outlet slit.

Figure 6A:
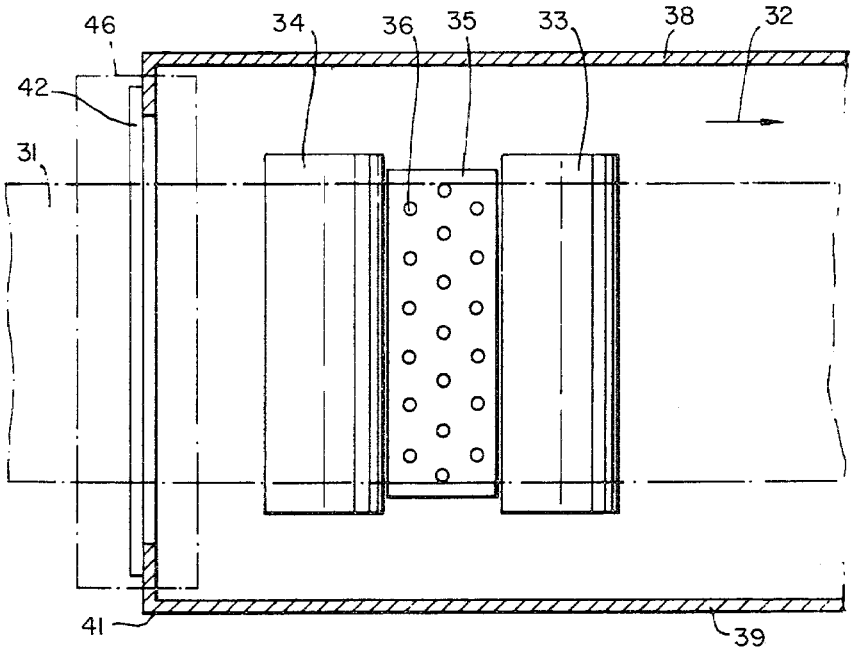
FIG. 6*a* is a diagrammatic top sectional view of a strip cooling installation.
Figure 6B:
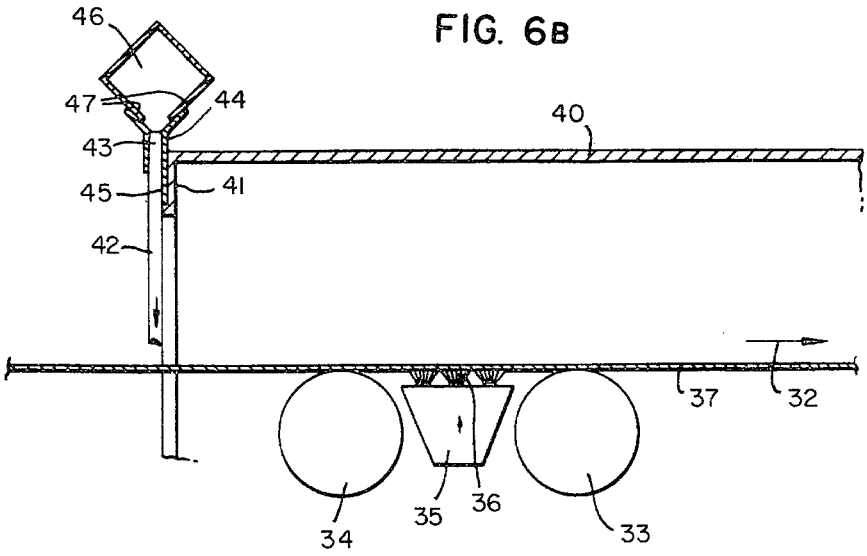
FIG. 6*b* is a diagrammatic side sectional view of the installation of FIG. 6*a.*

By way of non-limiting example, the accompanying drawings (FIG. 6) illustrate how easily such a water sheet can be obtained and how it is arranged so as to be fully effective for the intended object. The drawings diagrammatically show a longitudinal cross-section and a plan view with sectioned parts of a cooling installation for rolled products of the type mentioned above and provided with a device for carrying out the method according to the invention.

The drawings illustrate the case in which one is dealing with a steel sheet 1 emerging from a finishing rolling mill in the direction indicated by an arrow 32. This sheet penetrates the cooling device comprising a unit formed by two carrying rollers 33 and 34 and a cooling box 35 having mist sprayers 36 acting on the lower face 37 of the sheet.

This installation is disposed in a longitudinal tunnel which has side walls 38 and 39 and a ceiling 40, and whose inlet is plane and terminates with a plane and vertical guide frame or end wall 41. A water sheet 42 is provided at the inlet of the tunnel by means of a straight transverse channel 43 one outlet side wall 44 which has a vertical inner face 45 contained in a plane exactly coinciding with the plane containing the outer face of the frame 41. The face 45 extends downwards slightly beyond the face opposite to it, the water sheet from the channel adhering to the said face 45 by surface tension and being thus kept in perfect contact with the outer face of the guide frame 41 while perfectly enclosing the tunnel with no interruption in the water film. The channel 43 is supplied, by way of its convergent inlet with water from a transverse header 46 having a square cross-section and opening into the channel 43 by way of its lower convergent part 47. Only one water sheet installation at the inlet to the tunnel is illustrated in the drawing because the unit at the outlet of the tunnel is a mirror-image duplicate thereof having the same parts in reverse order with respect to the moving steel sheet.

Of course it is within the scope of the invention to add to the water forming the film or sheet a substance in suspension or solution which could be particularly useful for assisting or enhancing adhesion of the said film against the end face of the tunnel.

We claim:

1. A method of cooling a rolled metal product in the form of a strip by means of a cooling installation comprising coolant sprayers disposed in a tunnel having ends which terminate in planar end walls provided with openings for receiving said strip therein, the method comprising the steps of passing the product horizontally through said tunnel, spraying a coolant onto the strip in the tunnel by means of said sprayers, and closing each end of the tunnel by projecting a continuous water curtain having an inner face which faces the tunnel opening so that said inner face contacts the planar surfaces of the end walls of the tunnel along the entire periphery of the openings above the strip said end wall neither projecting through the curtain nor being out of contact with it at any point above the strip.

2. A method as claimed in claim 1, and further comprising directing said water curtain in a vertical plane perpendicular to said path.

3. A method of cooling a rolled metal product in the form of a strip comprising:

transporting the metal strip horizontally along a given path adjacent at least two hollow caissons arranged one inside the other and rigidly connected in spaced relationship, said caissons extending across said path, said caissons each having walls and holes through said walls, with the holes in the inner caisson axially aligned with the holes in the outer caisson;

enclosing said strip and caissons in a tunnel having open ends which terminate in planar end walls provided with openings for receiving said strip therein;

spraying coolant on the metal strip through said holes in said caissons; and closing each end of the tunnel by projecting a continuous water curtain having an inner face which faces the tunnel opening so that said inner face contacts the planar surfaces of the end walls of the tunnel along the entire periphery of the opening above the strip, the end walls neither projecting through the said curtain nor being out of contact with it at any point above the strip.

4. A method as claimed in claim 1 or 3, and further comprising producing the water curtain by passing water through an elongate channel having an elongated outlet slit extending along its lower portion, extending at least the two long sides of the slit in the direction of flow of the water curtains by providing plane guides of sheet material and thereby guiding the direction of flow of the water curtain leaving the slit.

5. A method as claimed in claim 4, and further comprising guiding the water curtain a greater distance on its inner face than on its outer face by extending one of the plane guides in the direction of flow of the water a slightly greater distance than the other plane guide, said one plane guide being on the side of the slit nearest the tunnel opening and having its face in contact with the water curtain extending above the tunnel coplanar with the adjacent end of the tunnel, and positioning said slit above said path so that the water curtain completely covers the opening in the end of the tunnel starting at said slit.

* * * * *